US008955649B2

(12) United States Patent
Yokobayashi

(10) Patent No.: US 8,955,649 B2
(45) Date of Patent: Feb. 17, 2015

(54) ELEVATOR AND CLEANING JIG FOR ELEVATOR GUIDE DEVICE

(75) Inventor: Makoto Yokobayashi, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 680 days.

(21) Appl. No.: 13/206,832

(22) Filed: Aug. 10, 2011

(65) Prior Publication Data

US 2012/0043167 A1 Feb. 23, 2012

(30) Foreign Application Priority Data

Aug. 19, 2010 (JP) ..... 2010-184063

(51) Int. Cl.

*B66B 7/00* (2006.01)
*B66B 7/04* (2006.01)
*B66B 7/12* (2006.01)

(52) U.S. Cl.

CPC ..... *B66B 7/044* (2013.01); *B66B 7/1292* (2013.01); *B66B 7/047* (2013.01); *A46B 2200/3073* (2013.01)
USPC ..... 187/414; 187/409; 15/88.1; 15/398

(58) Field of Classification Search

CPC ..... B66B 7/044; B66B 7/047; B66B 7/1292; A47L 13/40; A46B 2200/405; A46B 2200/3073
USPC ..... 187/404, 406, 414; 15/256.5, 398, 88.1; 104/124–127; 191/10, 29 R, 29 DM, 191/22 DM
IPC ..... B66B 7/04, 7/12
See application file for complete search history.

(56) References Cited

U.S. PATENT DOCUMENTS 2,060,018 A * 11/1936 Bernz ..... 15/1.51
3,905,452 A * 9/1975 Schirmer ..... 187/414
4,216,846 A * 8/1980 Wheeler ..... 187/409

(Continued)

FOREIGN PATENT DOCUMENTS

CN 1972857 A 5/2007
CN 101098824 A 1/2008
CN 101112957 A 1/2008
CN 101506081 A 8/2009
EP 995713 A1 * 4/2000 ..... B66B 7/12
JP 59-037269 U 3/1984

(Continued)

OTHER PUBLICATIONS

Email to Steven Spar, Stefan Kruer, re: Translation of JP 59 037269 U, May 28, 2014, 2 Page.*

*Primary Examiner* — William A Rivera
*Assistant Examiner* — Stefan Kruer
(74) *Attorney, Agent, or Firm* — Foley & Lardner LLP

(57) ABSTRACT

An elevator according to an embodiment of the present invention includes a guide rail installed in an elevator hoist way in a vertical direction, an elevator car that ascends and descends along the guide rail, an elevator guide device, and a cleaning jig for an elevator guide device. The elevator guide device is fixed to the elevator car, and guides the running elevator car along the guide rail without bringing the elevator car into contact with the guide rail while a predetermined clearance is maintained with the guide rail using magnetic force generated by a magnet guide unit. The cleaning jig for an elevator guide device is installed on the guide rail to come into contact with a magnetic pole of the magnetic guide unit to remove a foreign matter attached to a surface thereof when the elevator car passes the cleaning jig for an elevator guide device.

10 Claims, 12 Drawing Sheets

(56) References Cited

U.S. PATENT DOCUMENTS

| | | | | |
|---|---|---|---|---|
| 5,360,084 | A | 11/1994 | Graf | |
| 5,379,864 | A * | 1/1995 | Colby | 187/393 |
| 7,793,760 | B2 | 9/2010 | Ito et al. | |
| 7,841,451 | B2 | 11/2010 | Ito | |
| 7,924,128 | B2 | 4/2011 | Ito et al. | |
| 2007/0107993 | A1 * | 5/2007 | Miller et al. | 187/406 |
| 2008/0110701 | A1 | 5/2008 | Ito et al. | |
| 2008/0257655 | A1 | 10/2008 | Ito et al. | |
| 2009/0133970 | A1 | 5/2009 | Ito | |
| 2011/0162914 | A1 | 7/2011 | Ito et al. | |

FOREIGN PATENT DOCUMENTS

| | | | | | |
|---|---|---|---|---|---|
| JP | 05-046867 | U | | 6/1993 | |
| JP | 06064866 | A | * | 3/1994 | B66B 7/12 |
| JP | 06127866 | A | * | 5/1994 | B66B 7/12 |
| JP | 2002060164 | A | * | 2/2002 | B66B 7/12 |
| JP | 2003238050 | A | * | 8/2003 | B66B 7/12 |
| JP | 2004250127 | A | * | 9/2004 | B66B 7/04 |
| JP | 2005-350267 | A | | 12/2005 | |
| JP | 2009-215043 | A | | 9/2009 | |
| JP | 2010013219 | A | * | 1/2010 | B66B 7/12 |

* cited by examiner

ELEVATOR AND CLEANING JIG FOR ELEVATOR GUIDE DEVICE

CROSS-REFERENCE TO RELATED APPLICATION

The application is based upon and claims the benefit priority from Japanese Patent Application No. 2010-184063 filed on Aug. 19, 2010; the entire contents of which are incorporated herein by reference.

FIELD

The present invention relates to an elevator and a cleaning jig for an elevator guide device.

BACKGROUND

In an elevator, a pair of guide rails is built within an elevator hoist way in a vertical direction, and an elevator car coupled with one end portion of a main rope ascends and descends while being guided by the guide rails. Since the elevator car is guided along the guide rails, the elevator car has elevator guide devices.

Types of elevator guide devices include a roller type and a guide shoe type. In either type, the elevator guide devices are configured to guide the elevator while they are in contact with the guide rails. Therefore, vibration and noises are generated due to distortion and joints of the guide rails, which causes passengers in the elevator car to feel uncomfortable.

Accordingly, an elevator guide device has been proposed that guides a running elevator car without any contact by employing a magnet guide unit and controlling attracting force of magnets exerted between the magnets and iron guide rails that are provided to face each other (see Japanese Patent Application Laid-Open No. 2005-350267).

SUMMARY OF THE INVENTION

However, since the above magnet guide unit has a permanent magnet, foreign matters such as scrap iron and iron powder attach to the tip of the electromagnet (magnetic pole). Therefore, even after supply of electric power to the electromagnet is stopped, the foreign matters keep on attaching to the surface of the electromagnet. As a result, the attracting force of the electromagnet changes, which makes it difficult for the magnet guide unit to stably guide the running of the elevator car. Therefore, it is necessary to do a work of removing the foreign matters attached to the magnet guide unit. In this case, the elevator car is descended to the lowest floor of the elevator hoist way, and thereafter a worker has to enter into a pit unit below the lowest floor, and a cleaning staff member has to manually remove the foreign matters attached to the magnet guide unit. Therefore, there is a problem in that the efficiency of work is low.

Accordingly, the present invention is made in view of the above problems associated with conventional techniques, and it is an object of the present invention to provide an elevator and a cleaning jig for an elevator guide device that can automatically and efficiently remove foreign matters attached to a magnet guide unit of an elevator guide device.

An elevator according to an embodiment of the present invention includes a guide rail installed in an elevator hoist way in a vertical direction, an elevator car that ascends and descends along the guide rail, an elevator guide device, and a cleaning jig for an elevator guide device. The elevator guide device is fixed to the elevator car, and guides the running elevator car along the guide rail without bringing the elevator car into contact with the guide rail while a predetermined clearance is maintained with the guide rail using magnetic force generated by a magnet guide unit. The cleaning jig for the elevator guide device installed on the guide rail to come into contact with a magnetic pole of the magnetic guide unit to remove a foreign matter attached to a surface thereof when the elevator car passes the cleaning jig for an elevator guide device.

DETAILED DESCRIPTION

Embodiments of the present invention will be hereinafter described in detail with reference to drawings. In the explanation below, a direction connecting a pair of right and left guide rails provided in an elevator hoist way will be referred to as a horizontal direction (X axis direction), a direction perpendicular to the ground will be referred to as a vertical direction (Z axis direction), and a direction perpendicular to both of these directions will be referred to as a front/back direction (Y axis direction).

First Embodiment

Figure 1A:
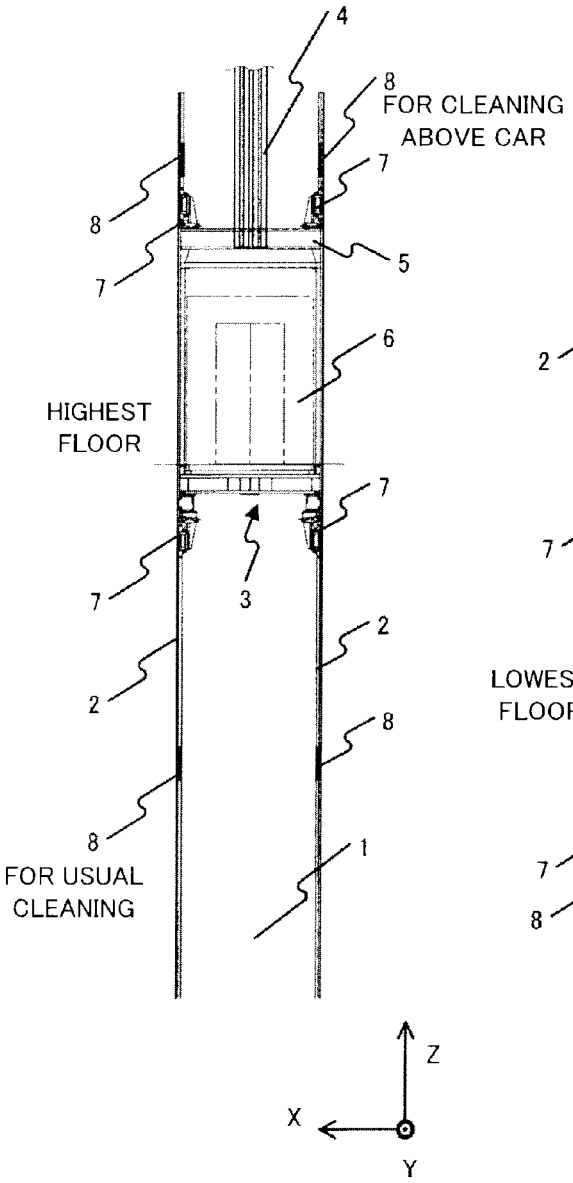
FIGS. 1A and 1B are schematic diagrams illustrating an example of overall configuration of an elevator according to a first embodiment of the present invention.
Figure 1B:
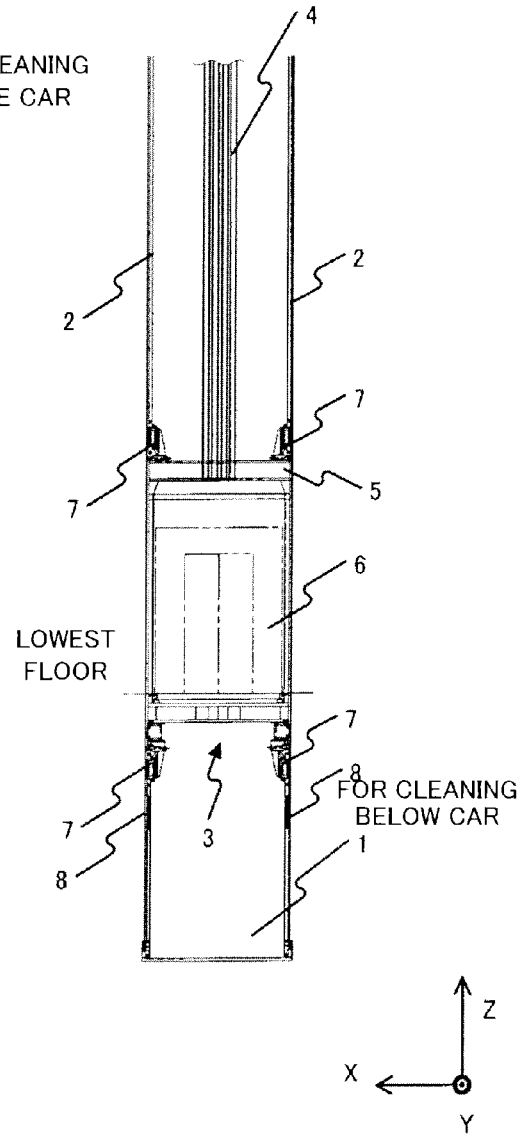
Figure 2:
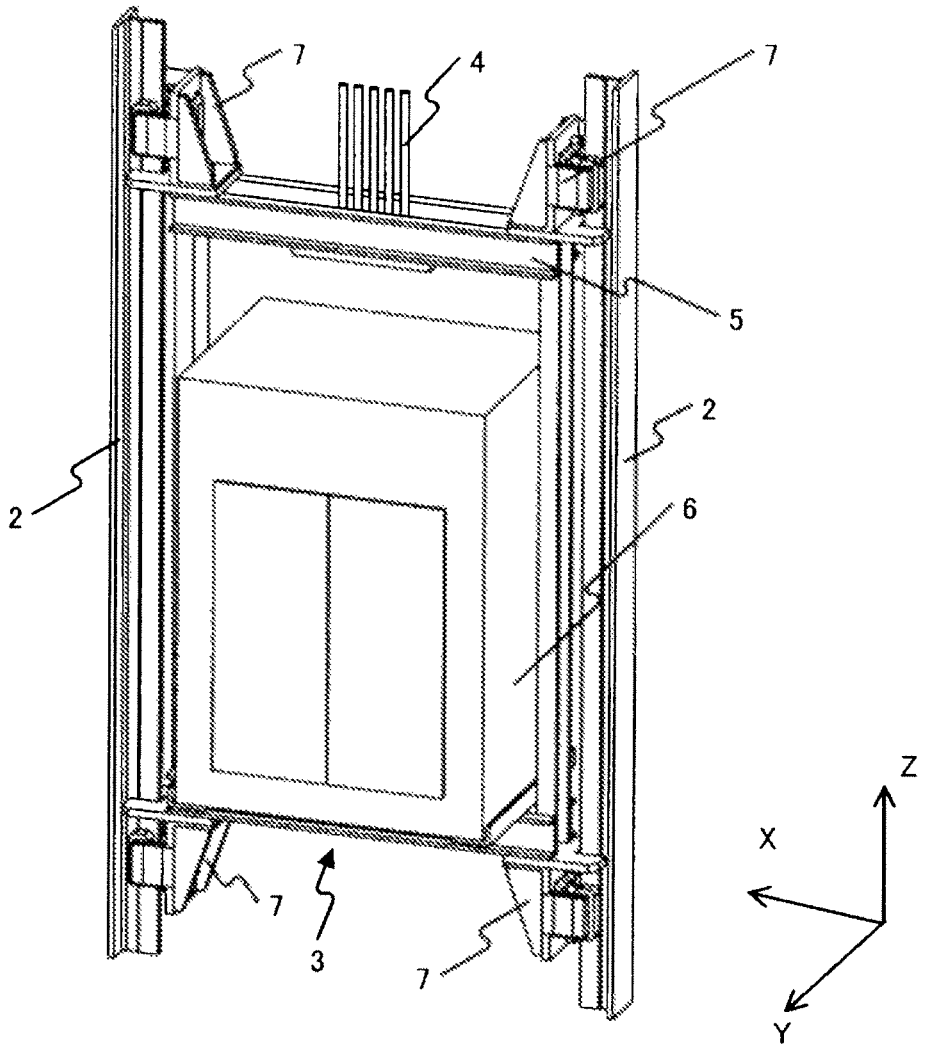
FIG. 2 is an enlarged perspective view illustrating an elevator as shown in FIG. 1.

FIGS. 1A and 1B are schematic diagrams illustrating an example of overall configuration of an elevator according to the first embodiment of the present invention. FIG. 2 is an enlarged perspective view illustrating the elevator as shown in FIG. 1. As shown in these figures, a pair of right and left guide rails 2 is installed on inner walls of an elevator hoist way 1 for the elevator facing to each other. The pair of right and left guide rails 2 is made of ferromagnetic material and extends in the vertical direction. An elevator car 3 is connected to one end portion of a main rope 4 wrapped around a winding machine (not shown), and the elevator car 3 descends and ascends along the guide rails 2. The elevator car 3 is constituted by a car frame 5 and a car room 6. Elevator guide devices 7 are fixed at four corners of the upper and lower sides of the car frame 5, so that they respectively face the guide rails 2. The elevator guide device 7 is guiding the running elevator car 3 along the guide rails 2 without bringing the elevator car 3 into contact with the guide rails 2 while a predetermined clearance is maintained with the guide rails 2 using magnetic force generated by the magnet guide units. Further, a plurality of cleaning jig for an elevator guide devices 8 are provided in desired sections of the guide rails 2. When the elevator car 3 passes by the cleaning jig for an elevator guide devices 8, the cleaning jig 8 come into contact with the elevator guide devices 7 to remove foreign matters attached to the surfaces of the magnetic poles of the elevator guide devices 7. After the cleaning jig 8 come into contact with the elevator guide devices 7, the cleaning jig 8 is required to remove the foreign matters while gradually deforming not to hinder ascend or descend of the elevator car 3. Therefore, the cleaning jig 8 is preferably resin-formed product in which the contact portions have appropriate elastic force, length, and strength.

FIG. 1A shows a pair of cleaning jig for an elevator guide devices 8 installed within the guide rails 2 above the highest floor, and another pair of cleaning jig for an elevator guide devices 8 installed in a pass section for the elevator car 3. FIG. 1B shows a pair of cleaning jig 8 installed in a pit below the lowest floor. When the cleaning jig 8 is installed in the pass section for the elevator car 3, the elevator guide devices 7 can be cleaned every time the elevator car 3 passes the position where the jigs are installed. In contrast, when the cleaning jig is installed above the highest floor or below the lowest floor, i.e., outside of the pass section for ordinary operation, an elevator control device (not shown) controls rotational drive of a winding machine (not shown) to move the elevator guide devices 7 to the position where the cleaning jig 8 is installed and controls the elevator guide devices to repeatedly move up and down from this installed position in the vertical direction (hereinafter referred to as "cleaning operation mode"), so that the elevator guide devices 7 can be intensively cleaned.

Figure 3:
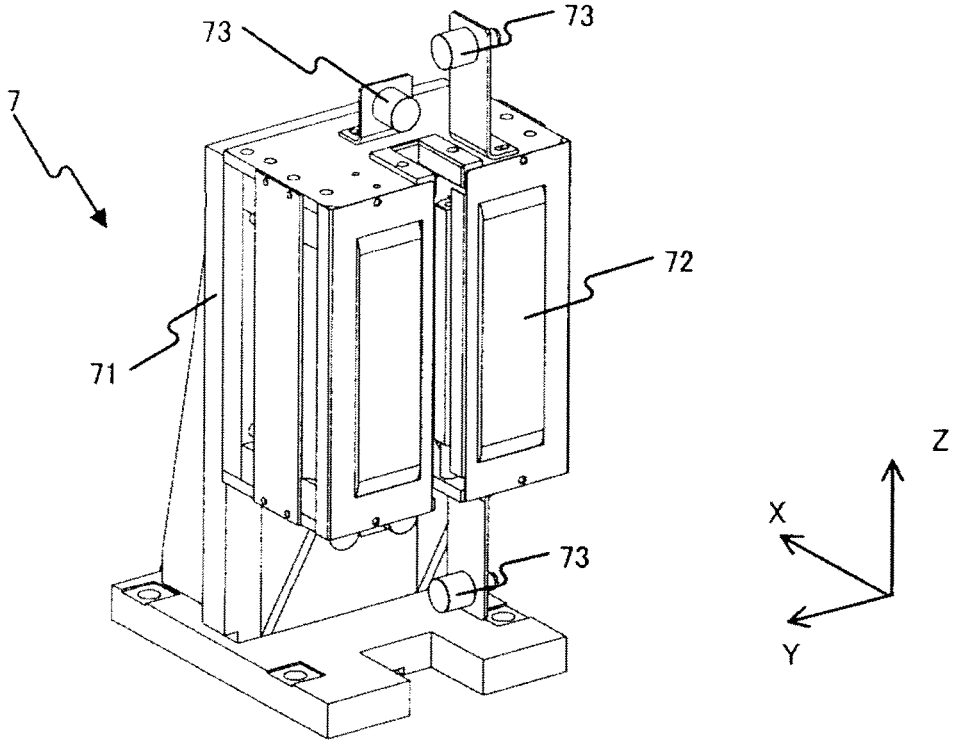
FIG. 3 is an external view illustrating an elevator guide device as shown in FIG. 1.

FIG. 3 is an external view illustrating the elevator guide device 7 as shown in FIG. 1. As shown in the figure, the elevator guide device 7 has such a structure that a magnet guide unit 72 and a displacement sensor 73 are attached to a base 71 made of non-magnetic material (such as aluminum, stainless steel, and plastic). The magnet guide unit 72 has a recessed section so as to enclose the tooth surface of the guide rails 2 from three directions. The displacement sensor 73 measures the clearances between the magnet guide unit 72 and the guide rails 2 in the X axis direction and the Y axis direction.

Figure 4:
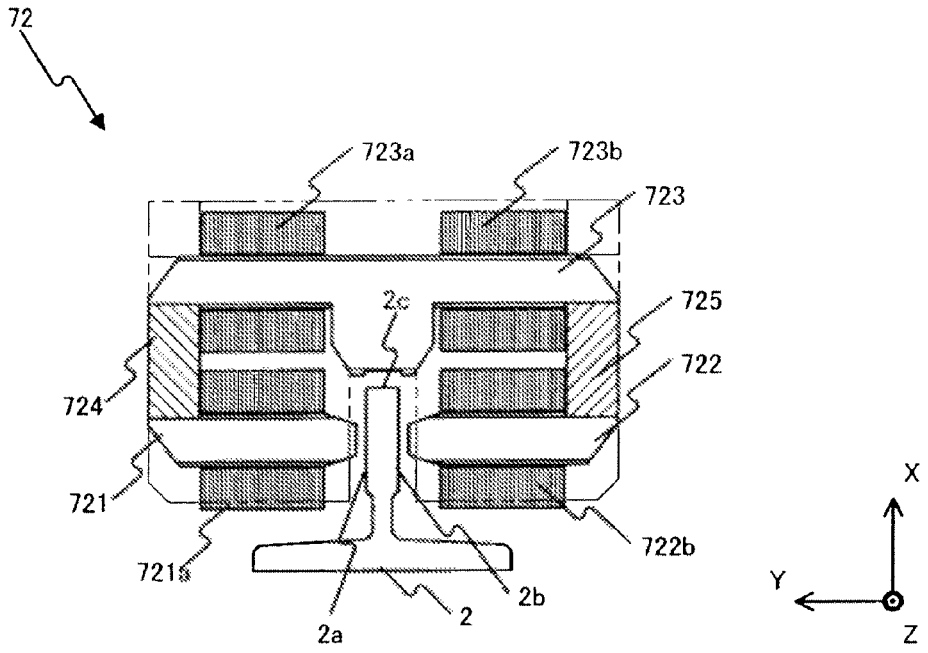
FIG. 4 is a circuit configuration diagram illustrating the elevator guide device as shown in FIG. 3.

FIG. 4 is a cross sectional view illustrating the magnet guide unit 72 as shown in FIG. 3. In this case, tooth surfaces perpendicular to y direction of the guide rails 2 with respect to surfaces facing the recessed portion of the magnet guide unit 72 are defined as a first guide tooth surface 2*a* and a second guide tooth surface 2*b*, and a tooth surface perpendicular to the X axis direction is defined as a third guide tooth surface 2*c*. As shown in the figure, the magnet guide unit 72 is provided with a first electromagnet 721 and a second electromagnet 722 so as to face the first guide tooth surface 2*a* and second guide tooth surface 2*b* of the guide rails 2. A third electromagnet 723 is provided to face the third guide tooth surface 2*c*. Coils 721*a*, 722*b* are wrapped around the first and second electromagnets 721, 722, and coils 723*a* and 723*b* are wrapped around the third electromagnet 723, so that exciting currents are supplied. The first and second electromagnets 721, 722 are coupled with the central third electromagnet 723 via a first permanent magnet 724 and a second permanent magnet 725 which are arranged so that the same poles face the first and second electromagnets 721, 722.

Figure 5:
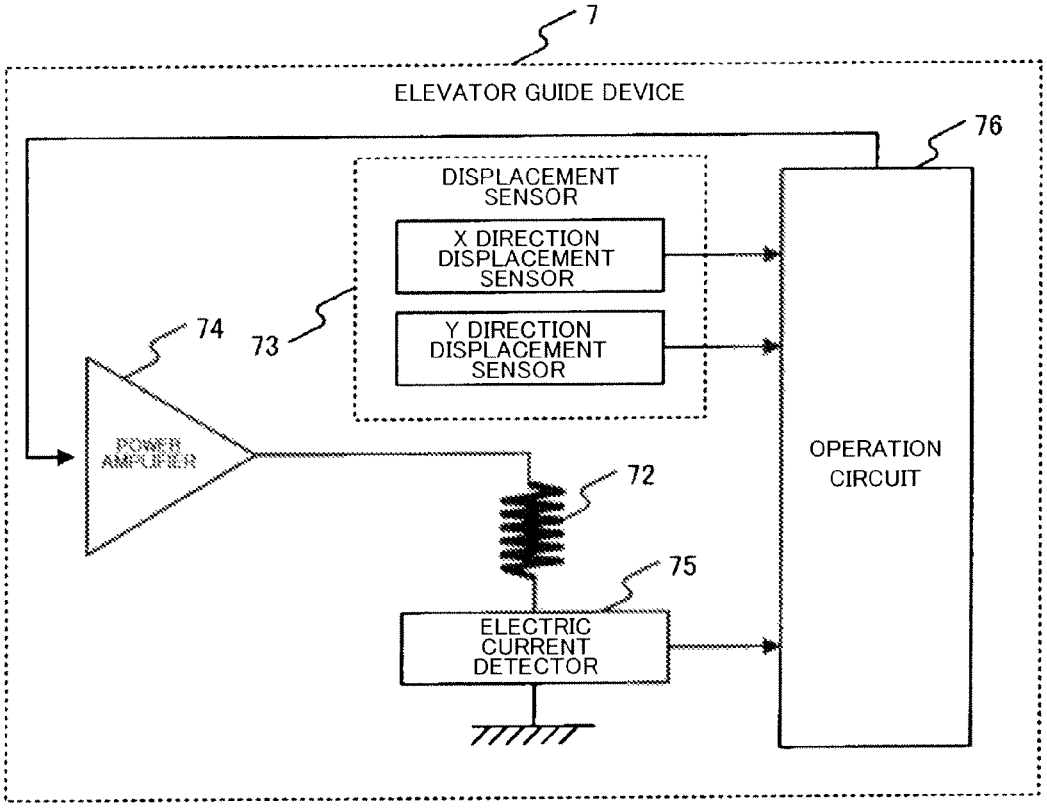
FIG. 5 is a cross sectional view illustrating the elevator guide device as shown in FIG. 3.

FIG. 5 is a circuit diagram of the elevator guide device 7 as shown in FIG. 1. As shown in the figure, the elevator guide device 7 includes a magnet guide unit 72, a displacement sensor 73, a power amplifier 74, an electric current detector 75, and an operation circuit 76. The operation circuit 76 receives detection signal provided by the electric current detector 75 detecting the exciting current value flowing in each electromagnet and the signal provided by the displacement sensor 73, calculates voltage values to be applied to the electromagnets 721, 722, 723 of the magnet guide unit 72, and provides the voltages to the first to third electromagnets 721, 722, 723 via the power amplifier 74. Thus, the exciting current provided to each electromagnet is controlled, so as to independently control the attracting forces in the X axis direction and the Y axis direction of the magnet guide unit 72 with respect to the guide rails 2.

Figure 6A:
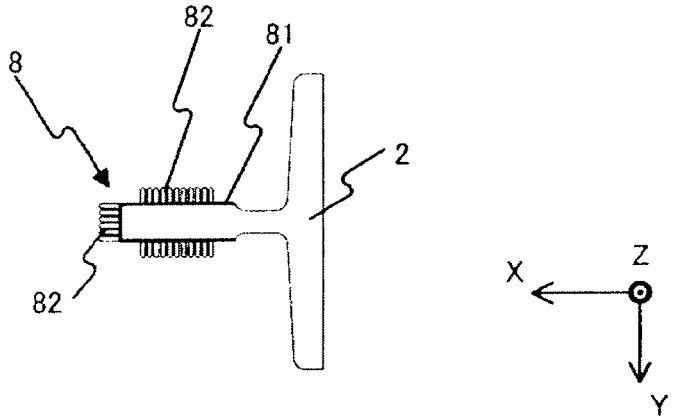
FIGS. 6A and 6B are a cross sectional view and a side view when the cleaning jig for an elevator guide device is installed in the elevator as shown in FIG. 1.
Figure 6B:
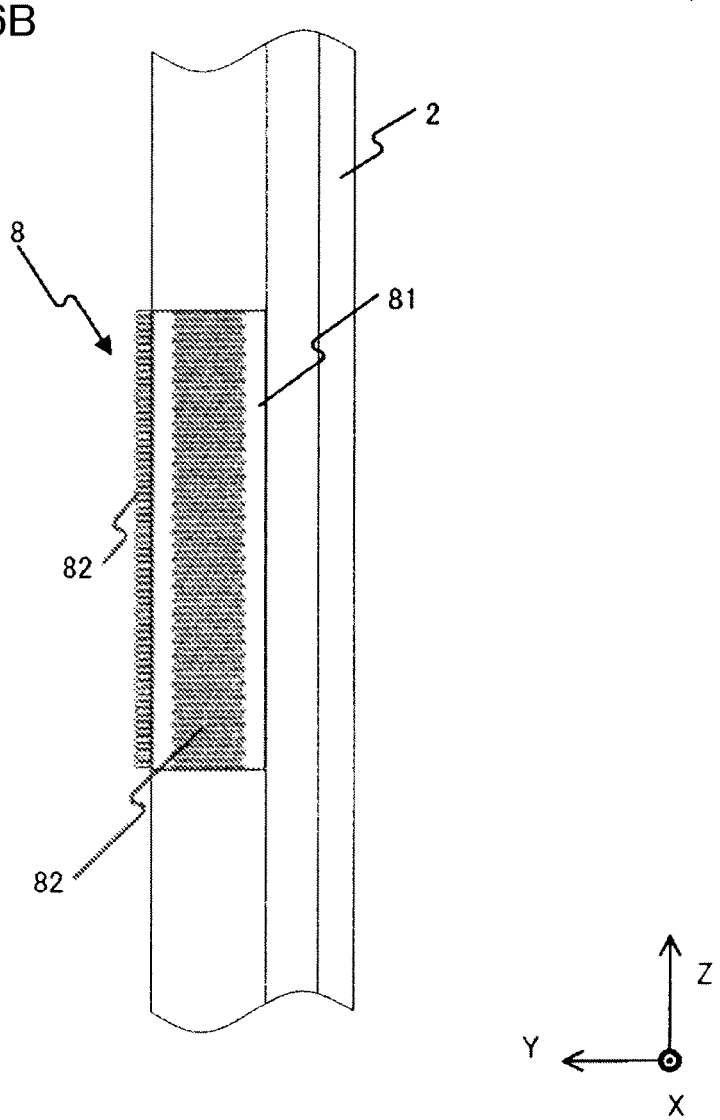

FIGS. 6A and 6B are a cross sectional view and a side view when the cleaning jig for an elevator guide device 8 is installed as shown in FIG. 1. In this case, the cleaning jig 8 includes a jig fixing unit 81 serving as a basis for fixing the jig to the tooth surfaces of the guide rail 2 and a magnet guide unit cleaning unit 82 for the magnet guide unit 72 made of resin members formed into a brush shape protruding from each of the tooth surfaces in directions perpendicular thereto. The cleaning jig 8 is fixed in a longitudinal direction (Z axis direction) to the tooth surface of the guide rail 2. As described above, the cleaning unit 82 is formed into brush shape, so that the foreign matters attached to the surface of the magnetic poles of the elevator guide device 7 (magnet guide unit 72) can be reliably removed.

Figure 7:
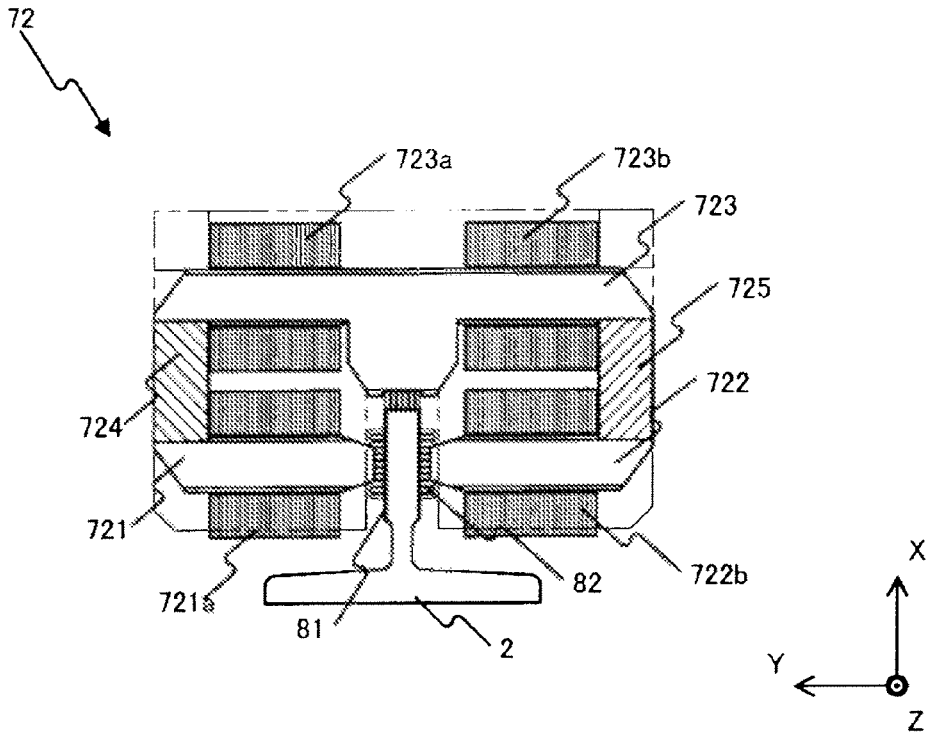
FIG. 7 is a cross sectional view when the elevator guide device as shown in FIG. 1 is into contact with the cleaning jig for an elevator guide device.

FIG. 7 is a cross sectional view when the elevator guide device 7 as shown in FIG. 1 is brought into contact with the cleaning jig for an elevator guide device 8. Here, end portions (magnetic poles) of the electromagnets 721, 722, 723 of the magnet guide unit 72 of the elevator guide device 7 are in contact with the end portions of the cleaning unit 82 of the cleaning jig 8. In this state, the elevator car 3 is operated to descend and ascend, so that the foreign matters such as iron powder attached to the end portions (magnetic poles) of the electromagnets 721, 722, 723 of the magnet guide unit 72 can be removed by the cleaning unit 82 formed into a brush shape.

Subsequently, a cleaning operation mode in the elevator control device (not shown) described above will be explained in detail. An ordinary procedure of the cleaning operation mode is as follows.

Step 1: Turn on the cleaning operation mode.

Step 2: The elevator car 3 is moved to the position where the cleaning jig for an elevator guide devices 8 are installed at an inspection operation speed. It should be noted that the position where the cleaning jig 8 are installed is set in advance.

Step 3: Start cleaning operation.

Step 4: The elevator guide devices 7 provided on the elevator car 3 pass the position where the cleaning jig 8 are installed. At this occasion, the magnet guide units 72 of the elevator guide devices 7 come into contact with the cleaning units 82 of the cleaning jig 8.

Step 5: After the elevator guide devices 7 passes the position, the operation direction of the elevator car 3 is reversed.

Step 6: Step 4 and step 5 are automatically repeated for the number of times defined.

Step 7: Finish the cleaning operation.

As described above, the elevator control device (not shown) controls rotational drive of the winding machine (not shown), so that the elevator guide devices 7 are moved to the position where the cleaning jig 8 are installed, and further, the elevator car 3 is repeatedly moved up and down from this installed position in the vertical direction. Therefore, the elevator guide devices 7 can be intensively cleaned. The cleaning operation mode can be likewise performed by specifying the position where the cleaning jig are installed, even not only when the cleaning jig 8 are installed in the pit unit but also in the pass section for the elevator car 3 within the guide rails 2. When the cleaning jig 8 are installed in the pass section for the elevator car 3, the elevator guide devices 7 can be cleaned at the same time as the usual descending and ascending operation.

Other embodiments of the present invention will be hereinafter explained. It should be noted that the same elements are denoted with the same reference numerals as those given to the first embodiment denote, and description thereabout is omitted. In each embodiment, difference from the first embodiment will be explained in detail.

Second Embodiment

Figure 8A:
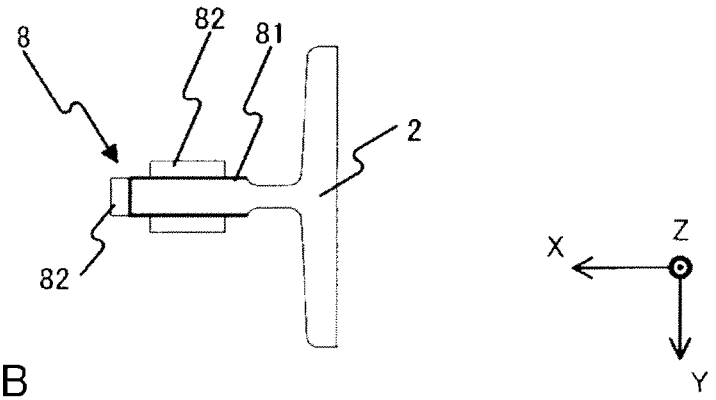
FIGS. 8A and 8B are a cross sectional view and a side view when the cleaning jig for an elevator guide device is installed in the elevator according to a second embodiment of the present invention.
Figure 8B:
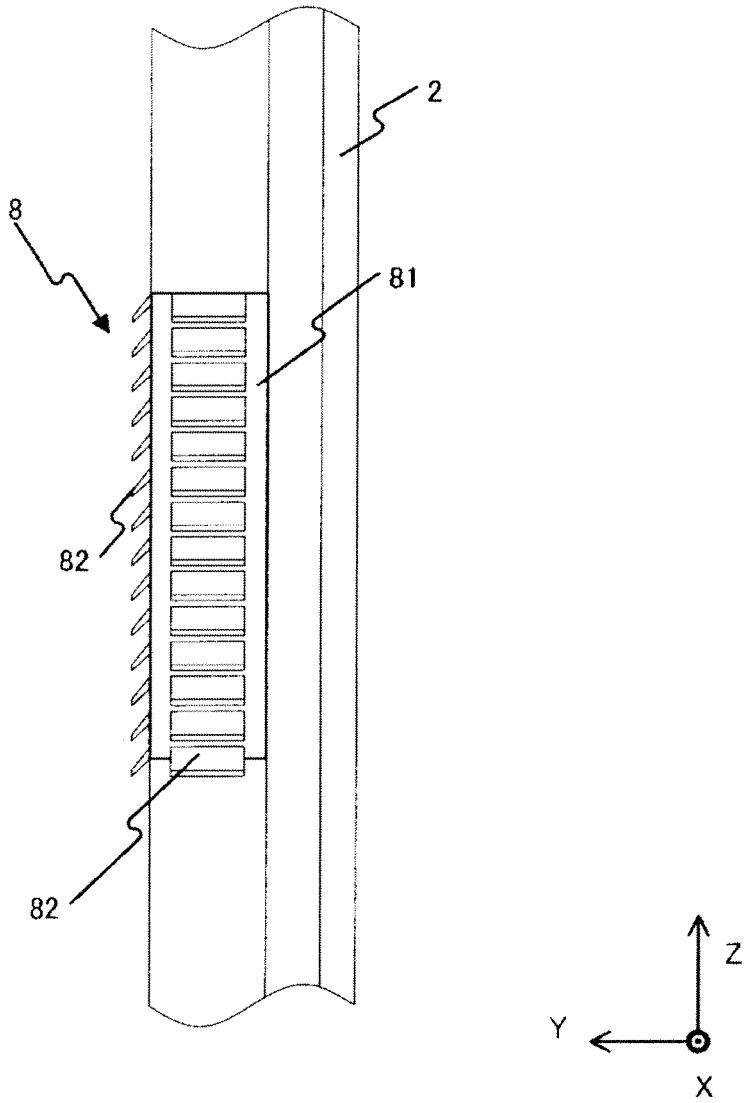

FIGS. 8A and 8B are a cross sectional view and a side view when the cleaning jig for an elevator guide device 8 is installed in an elevator according to the second embodiment of the present invention. The present embodiment is different from the first embodiment in that the magnet guide unit cleaning units 82 for the magnet guide unit 72 of the cleaning jig 8 are made by arranging a plurality of resin members formed in a spatular shape with a predetermined interval. As shown in FIG. 8B, the cleaning units 82 in the spatular shape extend in a diagonally downward direction with respect to the vertical direction (Z axis direction). Accordingly, the cleaning units 82 elastically deform according to operation direction of the elevator guide device 7, and it is easy to drop downward the foreign matters attached to the surface of the magnetic poles of the elevator guide device 7. As compared with the cleaning units 82 formed in the brush shape, there in an advantage in that the resistance during contact with the elevator guide device 7 can be reduced.

Figure 9A:
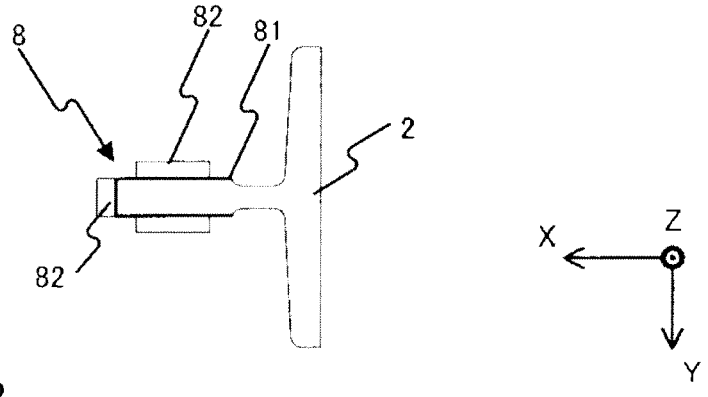
FIGS. 9A and 9B are a cross sectional view and a side view illustrating an example of modification of the cleaning jig for an elevator guide device as shown in FIG. 8.
Figure 9B:
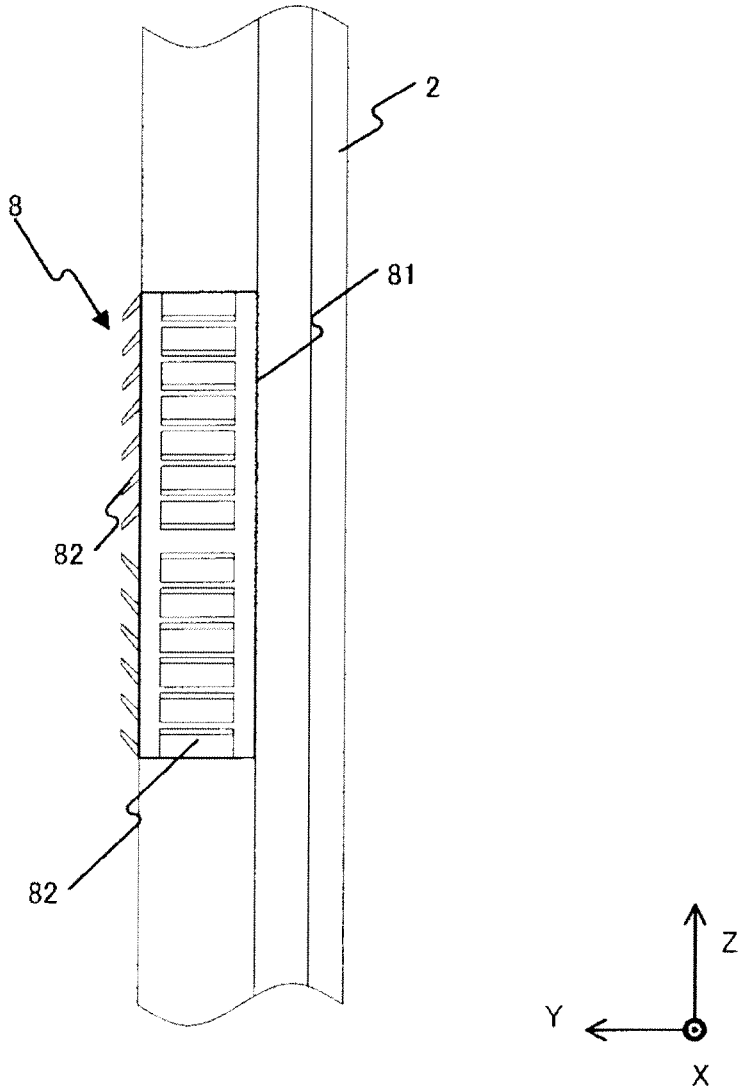

FIGS. 9A and 9B are a cross sectional view and a side view illustrating an example of modification of the cleaning jig for an elevator guide device 8 as shown in FIG. 8. As shown in FIG. 9B, this is different from FIG. 8B in that the upper half of the cleaning units 82 for the magnet guide unit extend in a diagonally downward direction with respect to the vertical direction (Z axis direction), and the lower half of the magnet guide unit cleaning units 82 extend in a diagonally upward direction with respect to the vertical direction (Z axis direction). In this manner, the cleaning units 82 are in two kinds of angles, so that even when there is a foreign matter that is difficult to be removed by the upper half (or the lower half) depending on the operation direction, there is an advantage in that the foreign matters can be removed when the foreign matters are into contact with the remaining portion.

Third Embodiment

Figure 10A:
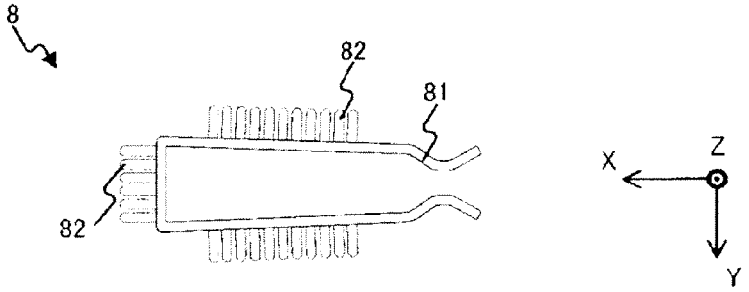
FIGS. 10A, 10B, and 10C are an enlarged view, a cross sectional view during installation, and a side view thereof, respectively illustrating the cleaning jig for an elevator guide device in an elevator according to a third embodiment of the present invention.
Figure 10B:
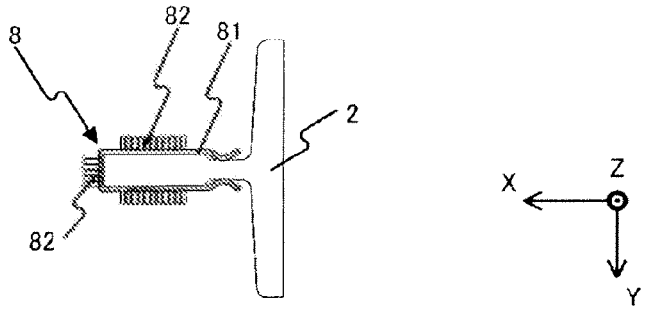
Figure 10C:
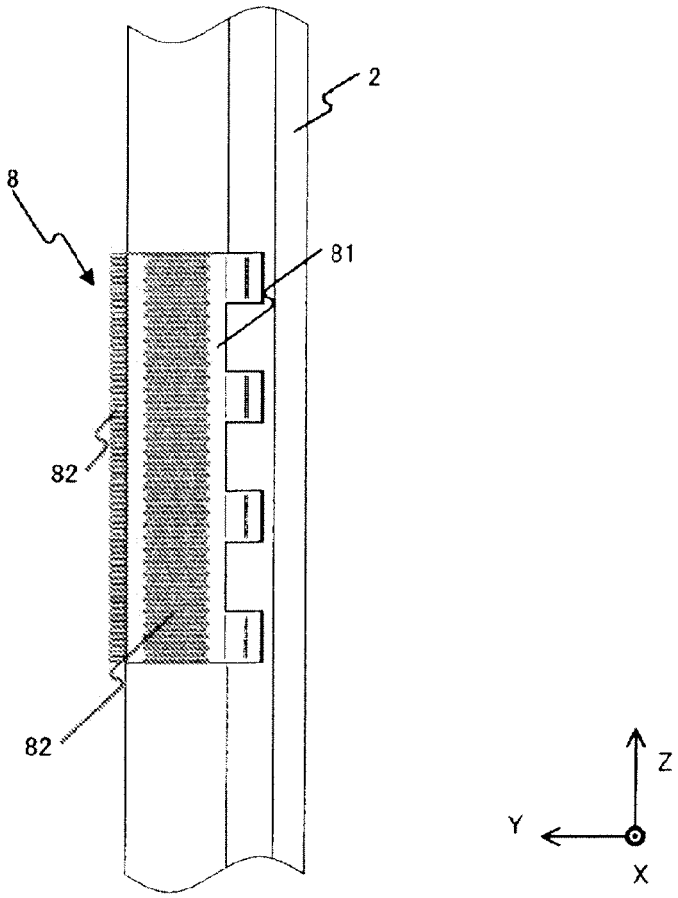

FIGS. 10A, 10B, and 10C are an enlarged view, a cross sectional view during installation, and a side view thereof illustrating an cleaning jig for an elevator guide device 8 in an elevator according to the third embodiment of the present invention. As shown in these figures, in the present embodiment, a jig fixing unit 81 is formed in a clip shape so that the cleaning jig 8 can be attached to and detached from a plurality of fixing mechanisms (for example, recessed portions with a predetermined interval) provided within the guide rail 2.

Figure 11:
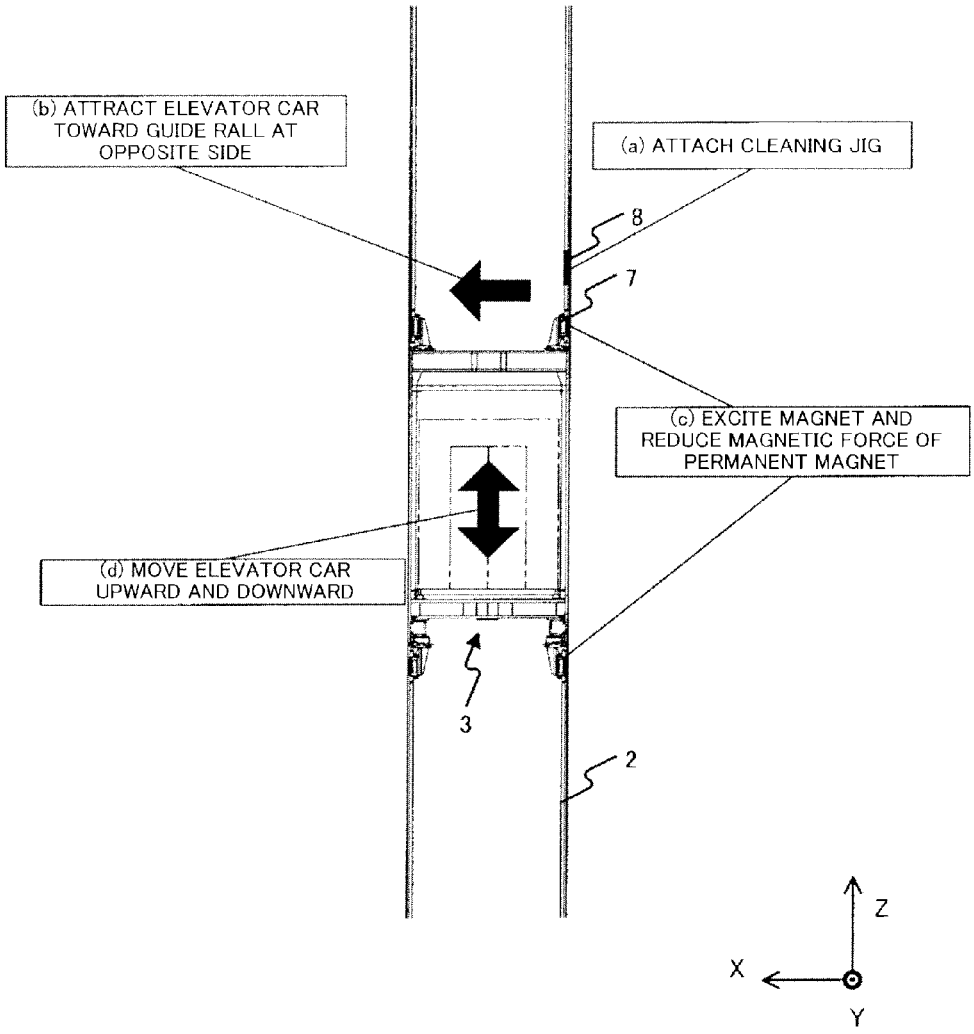
FIG. 11 is a figure illustrating another cleaning operation mode in the elevator according to the third embodiment of the present invention.

FIG. 11 is a figure illustrating another cleaning operation mode in the elevator according to the third embodiment of the present invention. The procedure of the cleaning operation mode is as follows.

Step 1: Turn on the cleaning operation mode.

Step 2: The cleaning jig for an elevator guide device 8 is attached to any position of one of the right and left guide rails (FIG. 11A).

Step 3: Start cleaning operation.

Step 4: The elevator control device controls the elevator guide devices 7 (magnet guide units 72) installed in the elevator car 3, and the elevator car 3 is attracted to one of the guide rails 2 to which the cleaning jig for an elevator guide device 8 is not installed (FIG. 11B).

Step 5: At the elevator guide device 7 (magnet guide unit 72) to which the elevator car 3 is not attracted, the magnetic force of the permanent magnet is reduced or erased by exciting the electromagnet (FIG. 11C).

Step 6: The elevator car 3 is moved upward and downward so that the elevator guide device 7 (magnet guide unit 72) passes the position where the cleaning jig for an elevator guide device 3 is installed (FIG. 11D).

Step 7: Finish the cleaning operation.

As described above, the magnetic force of the elevator guide device 7 (magnet guide unit 72) is controlled to move the elevator car 3 toward one of the guide rails 2, and to reduce the magnetic force of the permanent magnet exerted on foreign matters attached to the surface of the elevator guide device 7 (magnet guide unit 72) at the other of the guide rails 2, which is to be cleaned. Therefore, this enables efficient cleaning process. Moreover, since the cleaning jig for an elevator guide device 8 is detachably attached, there is an advantage in that it can be attached to a desired portion only when cleaning work is needed.

Fourth Embodiment

Figure 12A:
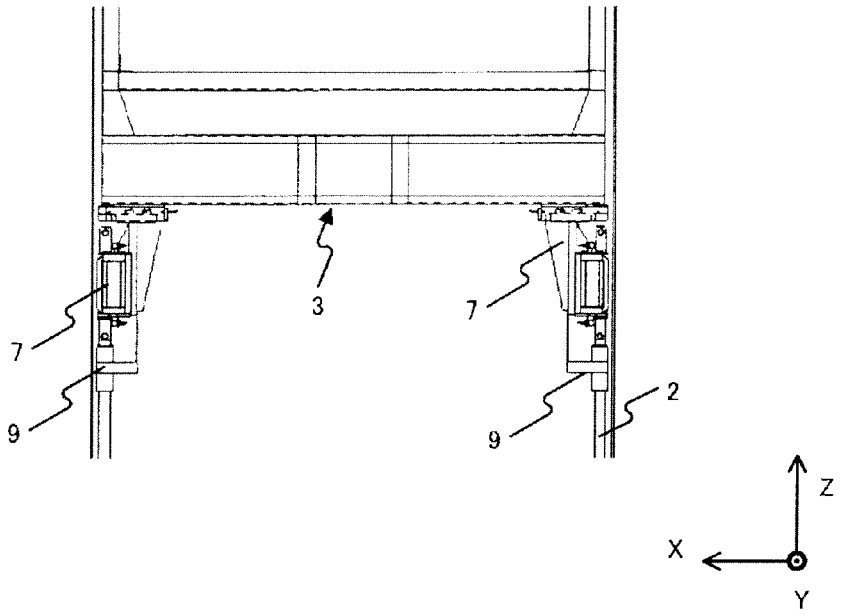
FIGS. 12A and 12B are a side view and a cross sectional view when guide rail cleaning jigs installed in the elevator according to fourth embodiment of the present invention.
Figure 12B:
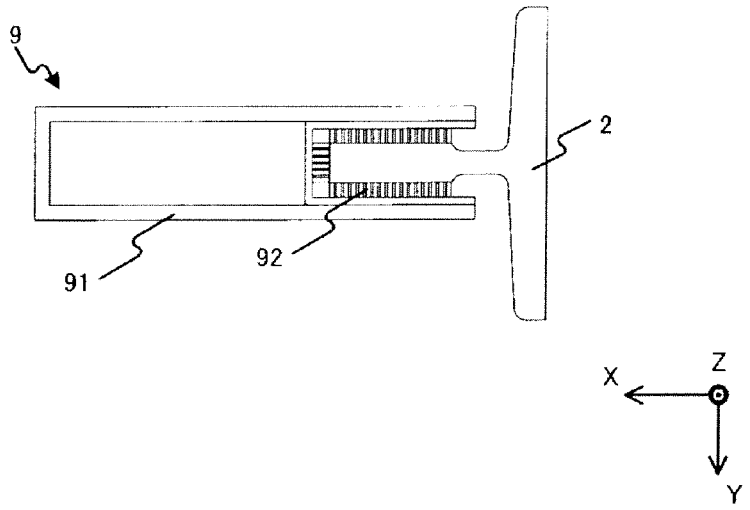

FIGS. 12A and 12B are a side view and a cross sectional view when cleaning jig for an elevator guide devices 8 are installed in an elevator according to the fourth embodiment of the present invention. As shown in the figure, the elevator according to the present embodiment further includes guide rail cleaning jigs 9 provided at a lower portion of the elevator car 3 to be brought into contact with the tooth surfaces of the guide rails 2, wherein the guide rail cleaning jigs 9 remove foreign matters attached to the tooth surfaces of the guide rails 2 when the elevator car 3 moves along the guide rails 2. FIG. 12B shows that the guide rail cleaning jig 9 is constituted by an attachment bracket 91 and a guide rails cleaning unit 92, and the guide rails cleaning unit 92 is formed of resin in a brush shape. As described above, when the guide rail cleaning jigs 9 are provided, foreign matters on the guide rails 2 drop downward during ascending and descending operation. Accordingly, there is an advantage in that this prevents foreign matters from attaching to the surfaces of the elevator guide devices 7 (magnet guide units 72) running on the guide rails 2.

Several embodiments of the present invention have been explained, but these embodiments are presented as examples, and are not intended to limit the scope of the invention. These new embodiments can be embodied in various other forms, and various kinds of omissions, replacements, and changes can be made without deviating from the gist of the invention. These embodiments and the modifications thereof are included in the scope and the gist of the invention, and are included in the invention described in the claims and the scope equivalent thereto.

What is claimed is:

1. An elevator comprising:

a guide rail installed in an elevator hoist way in a vertical direction;

an elevator car that ascends and descends along the guide rail;

an elevator guide device fixed to the elevator car and guiding the running elevator car along the guide rail without bringing the elevator car into contact with the guide rail while a predetermined clearance is maintained with the guide rail using magnetic force generated by a magnet guide unit;

a cleaning jig for the elevator guide device installed on the guide rail so as to come into contact with a magnetic pole of the magnetic guide unit to remove foreign matter attached to a surface thereof when the elevator car passes by the cleaning jig for the elevator guide device; and wherein the cleaning jig for the elevator guide device includes a plurality of cleaning units arranged with a predetermined interval along the guide rail and formed of spatula-shaped members, the plurality of cleaning units protruding from a tooth surface of the guide rail.

2. The elevator according to claim 1, wherein the cleaning jig for an elevator guide device further includes a fixing unit configured to fix the cleaning unit to the guide rail.

3. The elevator according to claim 2, wherein the fixing unit is formed to cover first to third tooth surfaces in a horizontal section of the guide rail, and a plurality of spatula-shaped members forming the cleaning unit are formed to respectively protrude from the first to third tooth surfaces in a diagonal direction.

4. The elevator according to claim 2, wherein the fixing unit is formed in a clip shape and is configured to detachably attach the cleaning unit to the guide rail.

5. The elevator according to claim 1, further comprising an elevator control device that controls a cleaning operation mode in which the elevator car is repeatedly moved upward and downward from a position where the cleaning jig for the elevator guide device is installed.

6. The elevator according to claim 5, wherein the elevator guide device performs control so as to excite an electromagnet in a direction for reducing or erasing magnetic force of a permanent magnet of the magnet guide unit and reduces the magnetic force of the magnetic pole during the cleaning operation mode.

7. The elevator according to claim 1, further comprising a guide rail cleaning jig provided at a lower portion of the elevator car so as to be in contact with a tooth surface of the guide rail, and wherein when the elevator car passes along the guide rail, the guide rail cleaning jig removes foreign matter attached to the tooth surface.

8. A cleaning jig for an elevator guide device used for an elevator, the elevator including:

a guide rail installed in an elevator hoist way in a vertical direction;

an elevator car that ascends and descends along the guide rail; and an elevator guide device fixed to the elevator car and guiding the running elevator car along the guide rail without bringing the elevator car into contact with the guide rail while a predetermined clearance is maintained with the guide rail using magnetic force generated by a magnet guide unit, wherein the cleaning jig for the elevator guide device includes a plurality of cleaning units arranged with a predetermined interval along the guide rail and formed of spatula-shaped members, the plurality of cleaning units protruding from a tooth surface of the guide rail, and when the elevator car passes by the cleaning jig for the elevator guide device, the cleaning jig for the elevator guide device comes into contact with a magnetic pole of the magnet guide unit and removes foreign matter attached to a surface of the magnet guide unit.

9. The cleaning jig for an elevator wide device according to claim 8, wherein the cleaning jig for the elevator guide device further includes a fixing unit configured to fix the cleaning unit to the guide rail.

10. The cleaning jig for an elevator guide device according to claim 9, wherein the fixing unit is formed to cover first to third tooth surfaces in a horizontal section of the guide rail, and a plurality of spatula-shaped members forming the cleaning units are formed to respectively protrude from the first to third tooth surfaces in a diagonal direction.

* * * * *